US006437755B1

(12) United States Patent
Joshi

(10) Patent No.: US 6,437,755 B1
(45) Date of Patent: Aug. 20, 2002

(54) IONIC SHIELD FOR DEVICES THAT EMIT RADIATION

(76) Inventor: Ashok V. Joshi, 4552 S. Thousand Oaks Dr., Salt Lake City, UT (US) 84124

( * ) Notice: Subject to any disclaimer, the term of this patent is extended or adjusted under 35 U.S.C. 154(b) by 0 days.

(21) Appl. No.: 09/755,586

(22) Filed: Jan. 5, 2001

(51) Int. Cl.[7] ..... H01Q 1/24
(52) U.S. Cl. ..... 343/841; 343/702
(58) Field of Search ..... 343/702, 841, 343/842, 872, 873; 455/90; 313/567, 230

(56) References Cited

U.S. PATENT DOCUMENTS

| | | | | |
|---|---|---|---|---|
| 2,934,066 | A | 4/1960 | Stowasser | 128/156 |
| 3,830,908 | A | 8/1974 | Klippel et al. | 424/28 |
| 4,267,168 | A | 5/1981 | Van Leuven | 424/75 |
| 4,446,124 | A | 5/1984 | Fox, Jr. et al. | 424/27 |
| 4,599,226 | A | 7/1986 | Fox, Jr. et al. | 424/27 |
| 4,606,962 | A | 8/1986 | Reylek et al. | 428/148 |
| 4,728,323 | A | 3/1988 | Matson | 604/304 |
| 4,767,401 | A | 8/1988 | Seiderman | 604/20 |
| 4,906,466 | A | 3/1990 | Edwards et al. | 424/78 |
| 5,052,381 | A | 10/1991 | Gilbert et al. | 128/155 |
| 5,320,908 | A | 6/1994 | Sodervall et al. | 428/461 |
| 5,330,452 | A | 7/1994 | Zook | 604/307 |
| 5,487,889 | A | 1/1996 | Eckert et al. | 424/93.1 |
| 5,736,591 | A | 4/1998 | Dunn | 523/122 |
| 5,782,788 | A | 7/1998 | Widemire | 602/48 |
| 5,977,241 | A * | 11/1999 | Koloski et al. | 524/502 |

* cited by examiner

*Primary Examiner*—Don Wong
*Assistant Examiner*—James Clinger
(74) *Attorney, Agent, or Firm*—Factor & Partners

(57) ABSTRACT

A radiation shield, for use in association with a device, such as a cellular telephone, having a radiation emitter, comprising a barrier positioned between a source of radiation and an object to be shielded, the barrier including means for converting radiation into ionic motion, to, in turn, dissipate the radiation and preclude the radiation from reaching an object to be shielded. The invention further comprises methods associated with the shielding of a user from radiation.

25 Claims, 2 Drawing Sheets

IONIC SHIELD FOR DEVICES THAT EMIT RADIATION

BACKGROUND OF THE INVENTION

1. Field of the Invention

The present invention relates in general to radiation shields, and more particularly to a shield which converts radiation into ionic movement to dissipate same. Such a shield is suitable for use with devices that emit radiation, for example, a cellular telephone which emits radiation from an antenna.

2. Background Art

Cellular telephones, and other devices, such as wireless devices, that communicate through the airwaves, transmit undesirable radiation when in use. While the relative quantity of radiation that is transmitted is not of great magnitude, repetitive use of such devices, especially in close proximity to the human body (i.e. a cellular telephone proximate the ear of the user), has been shown to impart relatively high levels of radiation which permeate the body of the user, and more particularly the head of the user. Such high levels of exposure have certain experts believing that the devices are relatively dangerous and may be a health risk.

One solution, designed to limit the quantity of radiation received by a user, has involved the use of separate microphone and speaker in the form of an earpiece. While this has limited the radiation emitted to the user, it is not without drawbacks. First, such a separate component adds complexity to the cellular telephone in the form of cords and plugs (which can become tangled and disconnect from the phone). Moreover, certain users are not comfortable with the use of earphones and microphones, and prefer the customary and conventional use of a telephone headset.

SUMMARY OF THE INVENTION

The invention comprises a radiation shield for use with a device that emits radiation. The shield comprises a barrier positioned between a source of radiation and an object to be shielded. The barrier includes means for converting radiation into ionic motion. In turn, the ionic motion dissipates the radiation and substantially precludes the radiation from reaching an object to be shielded.

In a preferred embodiment, the radiation converting means comprises an ionic conducting material positioned between the source of radiation and an object to be shielded. In one such embodiment, the ionic conducting material comprises a membrane supported by a frame. In one embodiment, the membrane is selected from the group consisting of one or more of: hydrated compounds, Nafion family materials, Nasicons, β Alumina, β" Alumina, chalcogenides, halides, oxides, solid polymer electrolytes, aqueous salt solutions and gels, as well as mixtures thereof. Preferably, the ionic conductor includes a conductivity of at least $10^{-8}$ siemens/cm at ambient temperature.

In another preferred embodiment, the barrier further includes means for removing heat from the radiation converting means. In one such embodiment, the heat removing means comprises a heat sink associated with the radiation converting means. In a particular such embodiment, the heat sink comprises a metal, a ceramic and/or a polymer substrate. Preferably, the heat sink may comprise one of the group consisting of aluminum, graphite, magnesia and steel, as well as mixtures and alloys thereof.

In another aspect of the invention, the invention comprises the radiation shield identified above used in combination with a device having an antenna capable of emitting radiation. In such an embodiment, the barrier including means for converting radiation imparted by the antenna to toward a user, into ionic motion.

In one such embodiment, the invention further comprises means for slidably positioning the barrier relative to an antenna. In another such embodiment, the invention includes means for pivoting the barrier relative to an antenna.

The invention further comprises a method of precluding damage to a user from radiation emitted by an antenna of a device. The method comprises the steps of providing a barrier having means for converting radiation into ionic motion and positioning the barrier between a radiation emitting antenna of the device and a body surface of a human, to, in turn, facilitate receipt of radiation by the barrier.

In a preferred embodiment, the method further comprises the step of adjusting the barrier relative to the antenna or relative to the device to maximize receipt of radiation by the barrier. In one such embodiment, the step of adjusting further comprises the step of pivotally rotating the barrier relative to the antenna or the device. In another such embodiment, the step of adjusting further comprises the step of slidably moving the barrier relative to the antenna or device.

In another embodiment of the method, the method further comprises the step of associating a heat sink with the barrier to, in turn, dissipate heat from the barrier.

The invention further comprises a method of dissipating radiation emitted by a device, such as a cellular telephone. This method comprises the steps of emitting radiation from an antenna of the device; receiving radiation into a barrier; and converting the radiation into ionic motion within the barrier.

In one preferred embodiment, the method further includes the step of dissipating the heat generated within the barrier.

In another preferred embodiment, the method further comprises the step of adjusting the barrier relative to the antenna to maximize the receipt of radiation by the barrier.

BEST MODE FOR PRACTICING THE INVENTION

Figure 1:
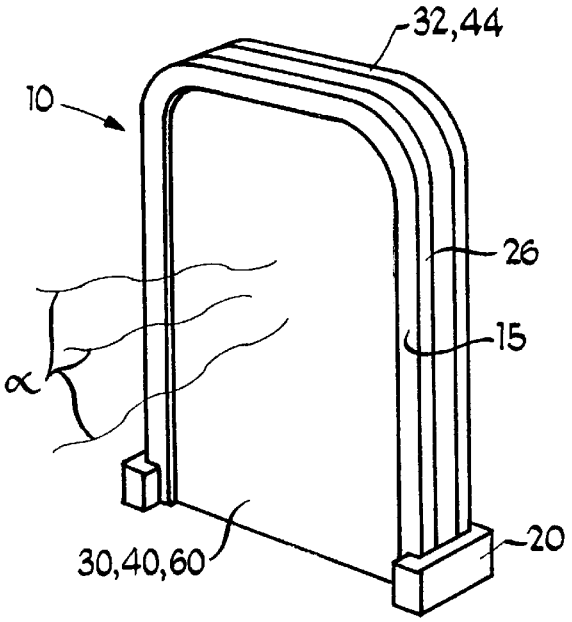
FIG. 1 of the drawings is a perspective view of the radiation shield of the present invention.

While this invention is susceptible of embodiment in many different forms, there is shown in the drawings and will be described in detail, several specific embodiments with the understanding that the present disclosure is to be considered as an exemplification of the principles of the invention and is not intended to limit the invention to the embodiments illustrated.

Figure 3:
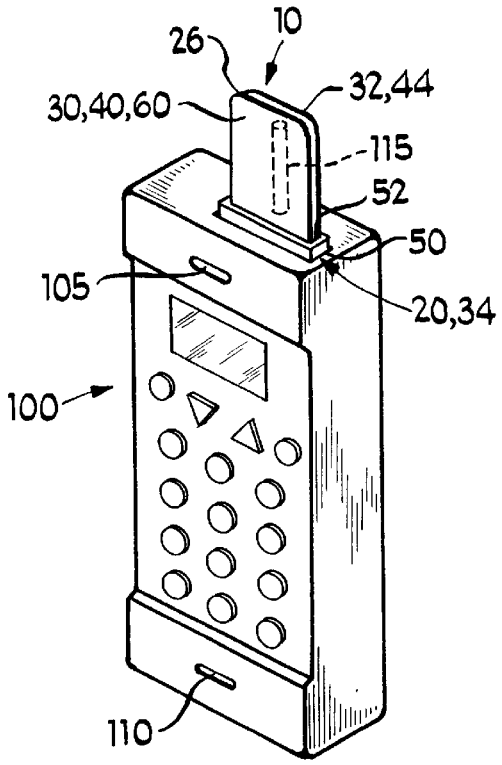
FIG. 3 of the drawings is a perspective view of the radiation shield of the present invention in combination with a cellular telephone, showing, in particular, a first embodiment of the adjustment means.
Figure 2:
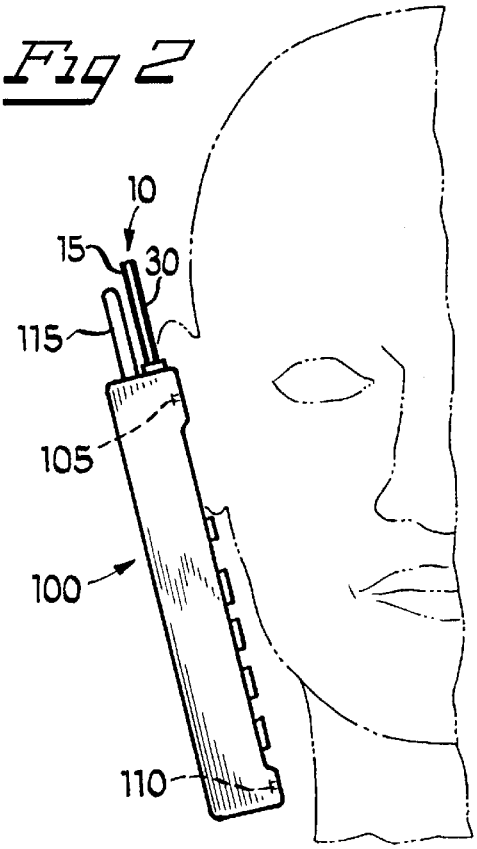
FIG. 2 of the drawings is a side elevational view of the radiation shield of the present invention in combination with a cellular telephone, showing, in particular, the shield an operating environment.
Figure 4:
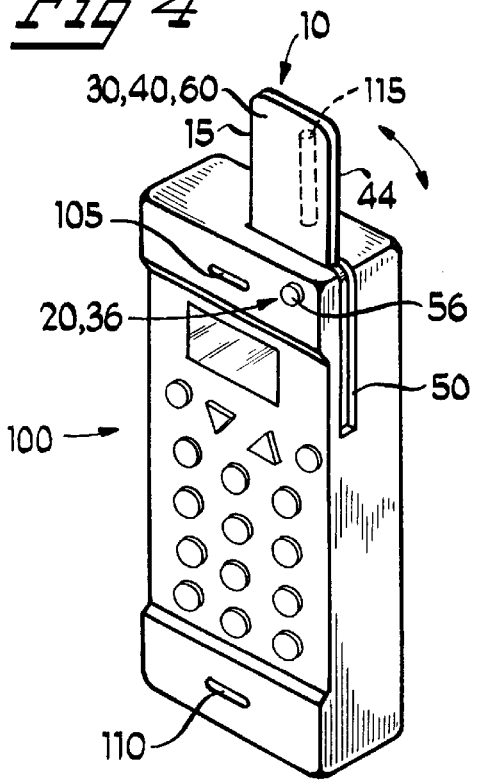
FIG. 4 of the drawings is a perspective view of the radiation shield of the present invention in combination with a cellular telephone, showing, in particular, a second embodiment of the adjustment means.

Referring now to the drawings, and, in particular, to FIG. 1 thereof, radiation shield is referred to generally as 10. Specifically, radiation shield 10 comprises barrier 15 which includes frame 26, means 30 for converting radiation into ionic motion and means 32 for removing heat from the radiation converting means. Radiation shield 10 is shown in FIGS. 2–4 as being associated with device 100 which may be a cellular telephone. The cellular telephone is of the type that includes speaker 105, microphone 110 and antenna 115. Antenna 115 emits outward radiation (i.e. waves of high frequency/short wavelength, such as microwaves) when device 100 (the cellular telephone) is in use. It has been determined that extended exposure to such radiation has harmful effects to humans and other animals. Of course, use of the device is not limited to cellular telephones, but has broader application to other devices that emit radiation, such as wireless communication devices and other business and consumer devices, for example, the wireless digital assistance device of FIG. 5.

Radiation converting means 30 is shown in FIGS. 1 and 3 as comprising ionic conducting material 40. In one embodiment, ionic conducting material 40 may comprise membrane 60 which is positioned and attached to frame 26 which, in turn, supports same. In other embodiments, the ionic conducting material may comprise a rigid structure which does not require frame 26 for support. While the radiation converting means 30 is shown in FIGS. 1–5 as comprising a substantially planar material, it is likewise contemplated that the radiation converting means may have various configurations, such as a surface configuration which, for instance, follows the contours of antenna 115, or of another feature of device 100. Moreover, while the radiation converting means is shown as comprising a material of substantially uniform thickness, various configurations, including those having varying thicknesses is likewise contemplated for use. As shown in FIG. 6, the device may be sized so as to effectively block a substantial majority of radiation, denoted by $\alpha$, imparted toward a user.

Depending on the embodiment, the material/membrane may comprise a variety of materials, including, but certainly not limited to, hydrated compounds ($SiO_2$, $Al_2O_3$, etc.), Nafion family materials, Nasicons, $\beta$ Alumina, $\beta''$ Alumina, chalcogenides, halides, oxides, solid polymer electrolytes, aqueous salt solutions and gels, as well as mixtures thereof. Such materials are configured so that the resulting radiation shield has an ionic conductivity of at least $10^{-8}$ siemens/cm at ambient temperature (i.e. about 70° F.).

Heat removing means 32 is shown in FIG. 1 and FIG. 3 as comprising heat sink 44. Heat sink 44 generally comprises metal, ceramic or polymer substrate which is positioned proximate the radiation converting means. In certain embodiments, the ionic conducting material may be attached directly to the heat removing means, wherein the heat removing means may provide additional support for the ionic conducting material. In certain embodiments, the heat sink may comprise a uniform member which matches the size of radiation converting means 30. In other embodiments, the heat sink may be of a configuration which is different than the radiation converting means, and may include non-uniform surfaces (i.e fins and the like). Most preferably, due to thermal conductivity characteristics, the heat sink comprises aluminum, graphite, magnesia or steel, as well as mixtures and alloys thereof, to adequately dissipate heat which is generated within the radiation converting means. In other embodiments, heat removing means 32 may comprise alone or in combination, heat sinks, fans and ventilation units (not shown).

Figure 5:
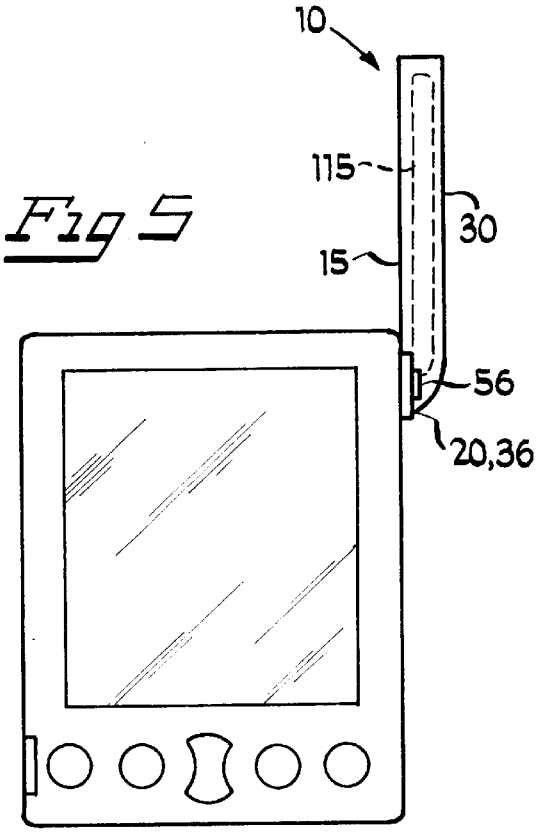
FIG. 5 of the drawings is a front elevational view of the radiation shield of the present invention in combination with a wireless digital assistant.
Figure 6:
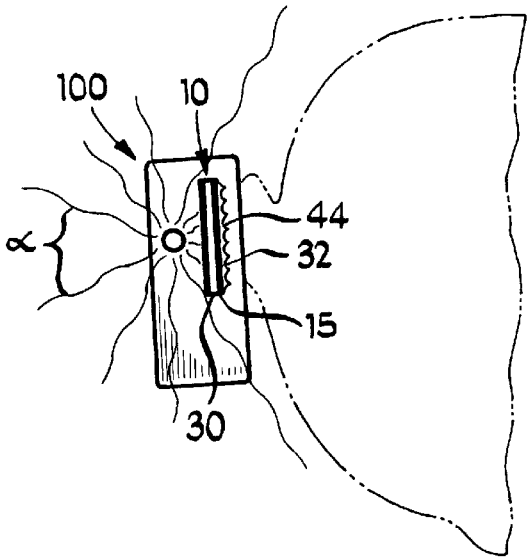
FIG. 6 of the drawings is a top plan view of the radiation shield of the present invention in combination with a cellular telephone.

Position adjusting means 20 is shown in FIGS. 3–5 as comprising slidable positioning means 34 (FIG. 3) and pivoting means 36 (FIG. 4). Slidable positioning means 34 includes slot 50 which cooperates with tabs 52. In the embodiment shown in FIG. 3, slot 50 extends into device (cellular telephone) 100, and slot 50 cooperates with tabs 52 so that barrier 15 can slide relative to device (cellular telephone) 100 and antenna 115. In other embodiments, the slot may be associated with the barrier and the tabs may be associated with the cellular telephone. In yet other embodiments, the slidable positioning means may be a separate component, rather than a component integrated with the cellular telephone.

Pivoting means 36 is shown in FIG. 4 as including axle 56 which is translationally fixed to device 100. Radiation shield 10 is permitted to rotate about axle 56 relative to device 100 and antenna 115 thereof. In the embodiment shown in FIG. 4, radiation shield 10 can rotate relative to cellular telephone 100 such that it may be placed in a stowed/collapsed position prior to use and in an operating orientation during use. In the embodiment shown in FIG. 5 (a digital assistant), shield 10 can rotate about axis 56 such that it can follow the position of antenna 115.

In operation, a device with an antenna that emits radiation is first provided to a user. Subsequently, radiation shield 10 is provided and associated with the device such that the radiation shield is positionable between the antenna (or other emitter of radiation) and the user's body when the device is in use.

Specifically, In the embodiment shown in FIG. 3, the radiation shield is slidably positionable from a stowed or collapsed position to an operating position proximate the antenna. Similarly, in the embodiments shown in FIGS. 4 and 5, the radiation shield is rotatably positionable from a position which is internal to the telephone to an operating position proximate the antenna. In yet other embodiments, the radiation shield may be in a fixed operating position.

Once the radiation shield is provided and positioned, as the user utilizes the cellular telephone and transmissions are made therefrom, radiation is emitted through the antenna. As shown in FIG. 6, radiation, $\alpha$, extends outwardly therefrom in all directions. Some of the radiation is directed to the radiation shield and toward the user. As the radiation reaches the radiation shield, the radiation conversion means associated with the radiation shield receives the radiation, and converts the radiation energy into ionic motion of the particles of the ion conversion means. In turn, the radiation is dissipated as ionic motion.

Naturally, the ionic motion results in the generation of heat. Depending on the intensity of radiation emitted, the amount of heat (i.e. the change in temperature) generated can vary. In certain instances, it may be advantageous, and/or necessary, to associate heat removal means with the radiation conversion means. Specifically, heat is transferred from the radiation conversion means to heat sink 44 of heat removal means 32 where it is dissipated to the surrounding air. In certain embodiments, the heat removal means may comprise a small fan or other ventilation unit which may be associated with the heat sink, or directly with the radiation conversion means. The fan may be used to increase circulation of air proximate the radiation converting means, to, in turn, dissipate heat generated by same.

Once the use of the device is completed, and the emission of radiation ceases, the user may adjust the shield from an operating position into a stowed or collapsed position.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A radiation shield for use in association with a device having a source of radiation emission, the radiation shield comprising:

a barrier positioned between a source of radiation and an object to be shielded, the barrier including means for converting radiation into ionic motion, to, in turn, dissipate the radiation and preclude the radiation from reaching an object to be shielded.

2. The radiation shield according to claim 1 wherein the radiation converting means comprises an ionic conducting material positioned between the source of radiation and an object to be shielded.

3. The radiation shield according to claim 2 wherein the ionic conductor includes a conductivity of at least $10^{-8}$ siemens/cm at ambient temperature.

4. The radiation shield according to claim 2 wherein barrier includes a frame and the ionic conducting material comprises a membrane supported by the frame.

5. The radiation shield according to claim 4 wherein the membrane selected from the group consisting of one or more of: hydrated compounds, Nafion family materials, Nasicons, β Alumina, β" Alumina, chalcogenides, halides, oxides, solid polymer electrolytes, aqueous salt solutions and gels, as well as mixtures thereof.

6. An apparatus comprising:

a device capable of communicating with other devices, the device having an antenna capable of emitting radiation; and a radiation shield including a barrier positioned between the antenna of the device and a user, when in an operating position, the barrier including means for converting radiation imparted by the antenna to toward a user, into ionic motion.

7. The apparatus according to claim 6 wherein the radiation converting means comprises an ionic conducting material positioned between the source of radiation and an object to be shielded.

8. The apparatus according to claim 7 wherein the ionic conducting material comprises a membrane.

9. The apparatus according to claim 6 wherein the barrier further includes means for removing heat from the radiation converting means.

10. The apparatus according to claim 9 wherein the heat removing means comprises a heat sink associated with the radiation converting means.

11. The apparatus according to claim 6 further comprising means for slidably positioning the barrier relative to an antenna.

12. The apparatus according to claim 6 further comprising means for pivoting the barrier relative to an antenna.

13. The apparatus according to claim 3 wherein the device comprises a cellular telephone.

14. A method of precluding damage to a user from radiation emitted by an antenna of a device, the method comprising the step of:

providing a barrier having means for converting radiation into ionic motion; and positioning the barrier between a radiation emitting antenna of the device and a body surface of a human, to, in turn, facilitate receipt of radiation by the barrier.

15. The method of claim 14 further comprising the step of:

adjusting the barrier relative to the antenna to maximize receipt of radiation by the barrier.

16. The method of claim 15 wherein the step of adjusting further comprises the step of:

pivotally rotating the barrier relative to one of the antenna and the device.

17. The method of claim 16 wherein the step of adjusting further comprises the step of:

slidably moving the barrier relative to one of the antenna and the device.

18. The method of claim 17 further comprising the step of:

associating a heat sink with the barrier to, in turn, dissipate heat from the barrier.

19. A method of dissipating radiation emitted by a device comprising the steps of:

emitting radiation from an antenna of the device;

receiving radiation into a barrier; and converting the radiation into ionic motion within the barrier.

20. The method of claim 19 further including the step of:

dissipating the heat generated within the barrier.

21. The method of claim 20 further comprising the step of:

adjusting the barrier relative to the antenna to maximize the receipt of radiation by the barrier.

22. A radiation shield for use in association with a device having a source of radiation emission, the radiation shield comprising:

barrier positioned between a source of radiation and an object to be shielded, the barrier including a means for converting radiation into ionic motion, to, in turn, dissipate the radiation and preclude the radiation from reaching an object to be shielded, the barrier further including a means for removing heat from the radiation means.

23. The radiation shield according to claim 22 wherein heat removing means comprises a heat sink associated with the radiation converting means.

24. The radiation shield according to claim 23 wherein the heat sink comprises one of a metal, a ceramic and a polymer substrate.

25. The radiation shield according to claim 24 wherein the heat sink comprises one of the group consisting of aluminum, graphite, magnesia and steel, as well as mixtures and alloys thereof.

* * * * *